US006176751B1

(12) United States Patent
Takahashi

(10) Patent No.: US 6,176,751 B1
(45) Date of Patent: Jan. 23, 2001

(54) ENGINE COVER UNIT OF OUTBOARD MOTOR

(75) Inventor: Satoru Takahashi, Hamamatsu (JP)

(73) Assignee: Suzuki Kabushiki Kaisha, Hamamatsu (JP)

( * ) Notice: Under 35 U.S.C. 154(b), the term of this patent shall be extended for 0 days.

(21) Appl. No.: 09/382,636

(22) Filed: Aug. 25, 1999

(30) Foreign Application Priority Data

Aug. 25, 1999 (JP) ..... 10-239144

(51) Int. Cl.[7] ..... B63H 20/32
(52) U.S. Cl. ..... 440/77; 440/76; 123/195 P
(58) Field of Search ..... 440/76, 77, 900; 123/195 P

(56) References Cited

U.S. PATENT DOCUMENTS 5,921,827 * 7/1999 Ichihashi ..... 440/77

* cited by examiner

*Primary Examiner*—Ed Swinehart
(74) *Attorney, Agent, or Firm*—Oblon, Spivak, McClelland, Maier & Neustadt, P.C.

(57) ABSTRACT

In an outboard motor, an engine is covered by an engine cover unit, and the engine cover unit comprises a lower cover section covering a surrounding of a lower portion of an engine in a usable state of an outboard motor arranged vertically, an upper cover section covering a surrounding of an upper portion of the engine, the upper cover section being mounted to be detachable to the lower cover section so as to provide an engine cover when mounted, and a height adjusting device provided for an inside surface of the lower cover section and adapted to adjust a height of the engine cover. The height adjusting device comprises a holder mounting member integrally mounted to the inside portion of the lower cover section and formed with a holder insertion groove, a cushion holder to be inserted into the holder insertion groove, an elastic member mounted to the cushion holder to be movable in an axial direction thereof, and a rib member provided to the upper cover section, the rib member having an end portion abutting against the elastic member in a state that the upper cover section is closed.

5 Claims, 5 Drawing Sheets

ENGINE COVER UNIT OF OUTBOARD MOTOR

BACKGROUND OF THE INVENTION

The present invention relates to an engine cover unit of an outboard motor particularly having a height adjusting device.

An outboard motor is provided with an engine which is disposed to an upper portion thereof in a state of the outboard motor mounted, for example, to a hull and is covered by an engine cover. The engine cover is generally composed of upper and lower two cover sections in a manner such that the lower cover section is secured to the outboard motor body and the upper cover section is constructed to be detachable therefrom for easy maintenance operation thereof.

The upper cover section has a rib member formed inside the upper cover section, the rib member being arranged so as to abut against a cushioning member arranged to an upper surface of the lower cover section thereby to adjust the vertical (height) position of the engine cover. A sealing member such as rubber is disposed at a mating portion of the upper and lower cover sections to keep water-tight structure of the engine cover.

However, because the sealing rubber has deteriorated as time elapses and, hence, its elastic property has been degraded, a gap is caused at the mating portion between the upper and lower cover sections, lowering the water-tight performance. In order to obviate such defect, Japanese Patent Laid-open Publication No. HEI 9-156592 provides a following solution. That is, a screw insertion hole is formed to a lower cover section so as to penetrate from the outside portion towards the inside portion thereof, and a cushioning member is provided to an upper end of an adjusting bolt screw engaged with the insertion hole. In this arrangement, when the adjusting bolt is rotated (screwed) so as to vertically move the cushioning member thereby to adjust the height of the upper cover section to absorb (eliminate) a gap caused between the upper and lower cover sections.

However, in this arrangement, the operation of the adjusting bolt requires a tool for operating the same and it is also necessary to form the insertion hole to the engine cover, providing a problem and damaging an outer appearance of the engine cover. Furthermore, it is necessary to pay attention to the sealing performance of the screw insertion hole.

SUMMARY OF THE INVENTION

An object of the present invention is to substantially eliminate defects or drawbacks encountered in the prior art mentioned above and to provide an engine cover unit of an outboard motor capable of adjusting a height of a cushioning member with a simple tool or like.

This and other objects can be achieved according to the present invention by providing an engine cover unit of an outboard motor in which a surrounding of an engine is covered by an engine cover, the engine cover unit comprising:

- a lower cover section covering a surrounding of a lower portion of an engine in a usable state of an outboard motor arranged vertically;
- an upper cover section covering a surrounding of an upper portion of the engine, the upper cover section being mounted to be detachable to the lower cover section so as to provide an engine cover when mounted; and
- a height adjusting means provided to an inside surface of the lower cover section and adapted to adjust a height of the engine cover, the height adjusting means comprising:

- a holder mounting member integrally mounted to the inside portion of the lower cover section and formed with a holder insertion groove;
- a cushion holder to be inserted into the holder insertion groove;
- an elastic member mounted to the cushion holder to be movable in an axial direction thereof; and
- a rib member provided to the upper cover section, the rib member having an end portion abutting against the elastic member in a state that the upper cover section is closed.

In a preferred embodiment, the cushion holder is formed with a circular insertion hole into which the cylindrical elastic member is fitted, the insertion hole being formed with a screw portion and the elastic member is formed with a thread to be engaged with the screw portion thereby to be movable in an axial direction thereof when engaged and rotated, the screw portion having a width corresponding to one pitch of the thread.

The cushion holder is detachably fitted to the holder insertion hole in shape of slit.

The elastic member is a cushioning member made of rubber.

The lower cover section is composed of a bilateral pair of side cover members and the height adjusting means is mounted to each of the side cover members to the same horizontal level.

According to the structures of the engine cover unit of the outboard motor according to the present invention mentioned above, the height of the elastic member, i.e. the upper cover section can be adjusted with a simple tool or manually and other specific functions and advantageous effects will be made clear from the following descriptions made with reference to the accompanying drawings.

DESCRIPTION OF THE PREFERRED EMBODIMENT

A preferred embodiment of the present invention will be described hereunder with reference to the accompanying drawings.

Figure 1:
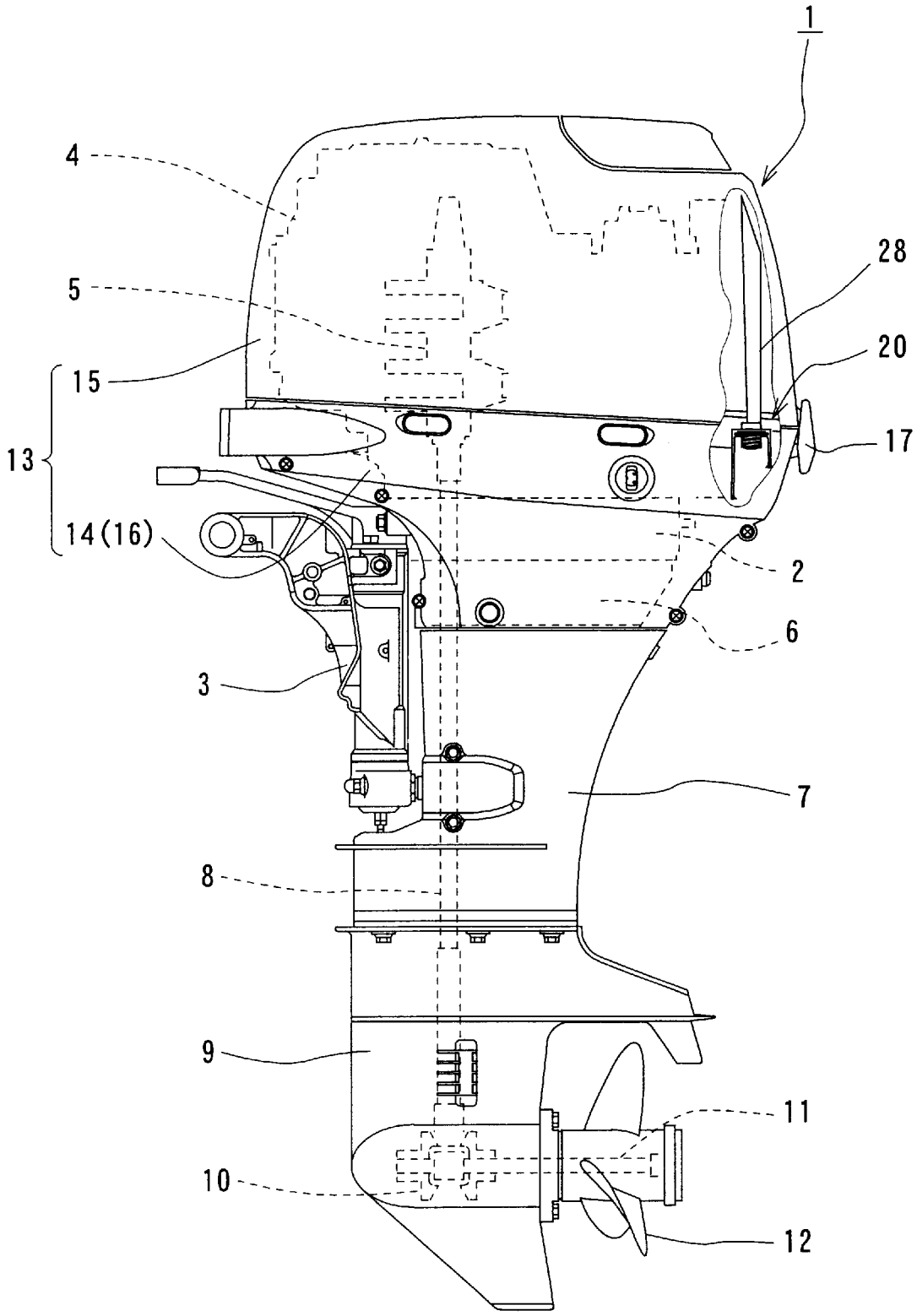
FIG. 1 is a left-side view of an outboard motor provided with an improved engine cover mounting structure according to the present invention.

FIG. 1 is a left side view of an outboard motor to which the present invention is applied.

With reference to FIG. 1, an outboard motor 1 is provided with an engine holder 2 and mounted to a hull, for example, through a bracket 3 mounted to the engine holder 2. An engine 4 is disposed above the engine holder 2 and a crank shaft 5 is arranged in the engine 4 to extend vertically perpendicularly.

An oil pan 6 for storing a lubrication oil is arranged below the engine holder 2 and a shaft housing 7 is disposed further below the oil pan 6. A drive shaft 8, having an upper end operatively coupled with the lower end of the crank shaft 5, extends downward inside the shaft housing 7. The lower end of the drive shaft 8 extends into a gear case 9, disposed below the shaft housing 7, so as to be operatively engaged with a bevel gear 10 and a propeller shaft 11, through which a propeller 12 is driven to be rotated when the engine 4 is driven and the crank shaft 5 is hence rotated.

The surroundings of the engine 4, the engine holder 2 and the oil pan 6 of the outboard motor 1 are covered with an engine cover 13 which is composed of two divided cover sections, i.e. lower and upper cover sections 14 and 15 in the state of the outboard motor mounted to the hull, for example, such as shown in FIG. 1. The lower cover section 14 covers the lower portion of the engine 4 and the surroundings of the engine holder 4 and the oil pan 6 and the upper cover section 15 covers the upper portion of the engine 4.

Figure 2:
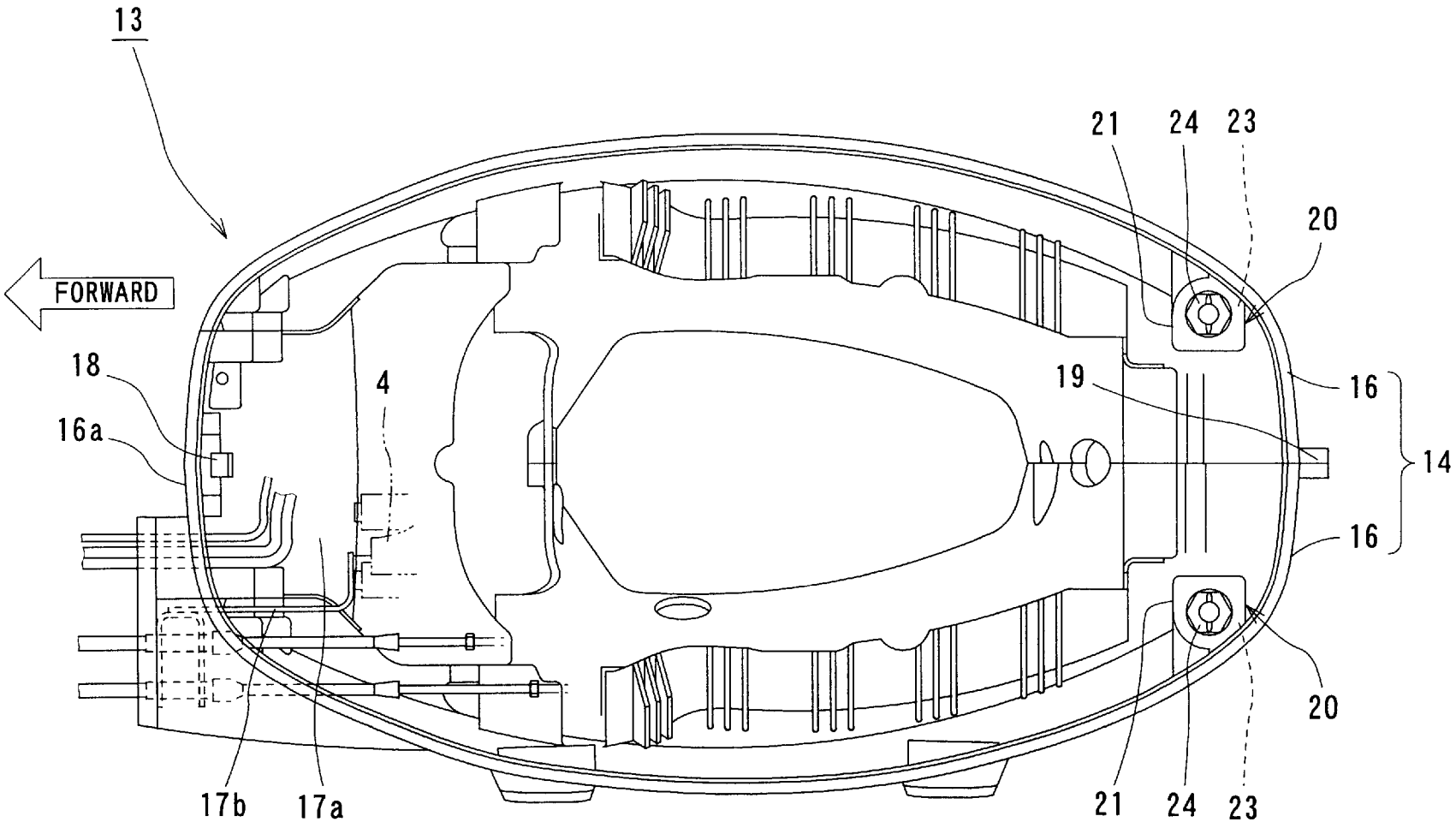
FIG. 2 is a plan view of a lower cover section of the engine cover of the outboard motor of FIG. 1.

The lower cover section 14 is further composed of a bilateral pair of side cover members 16 and a front cover member 16*a*. The side cover members 16 are fixed to the outboard motor body through a sealing rubber, not shown, and the front cover member 16*a* is fixed to the engine 4 through the bracket 16*b*. An upper opened end portion of the lower cover section 14, as shown in FIG. 2, is closed by the upper cover 15 to be detachable. In one preferred example, the front lower end of the upper cover section 15 is engaged with the front upper end of the lower cover section 14 and the rear lower end of the upper cover section 15 is engaged with the rear upper end of the lower cover section 14 by means of fastener 17. This is one example of arrangement of the upper and lower cover sections 14 and 15 and other detachable arrangements of the upper cover section 15 may be adopted.

That is, with reference to FIG. 2 showing a plane view of the lower cover 14 includes an integrated bilateral pair of side cover members 16, and the forward portion of the outboard motor 1, i.e. advancing direction of a hull, for example, to which the outboard motor 1 is mounted, is shown by an arrow "FORWARD". An engaging member 18 is provided to the inside portion of the front end of the lower cover section 14 so as to be engaged with the front lower end of the upper cover section 15, and an engaging projection 19 with which the fastener 17 is engaged is formed to the outside portion of the rear end of the lower cover section 14.

Figure 3:
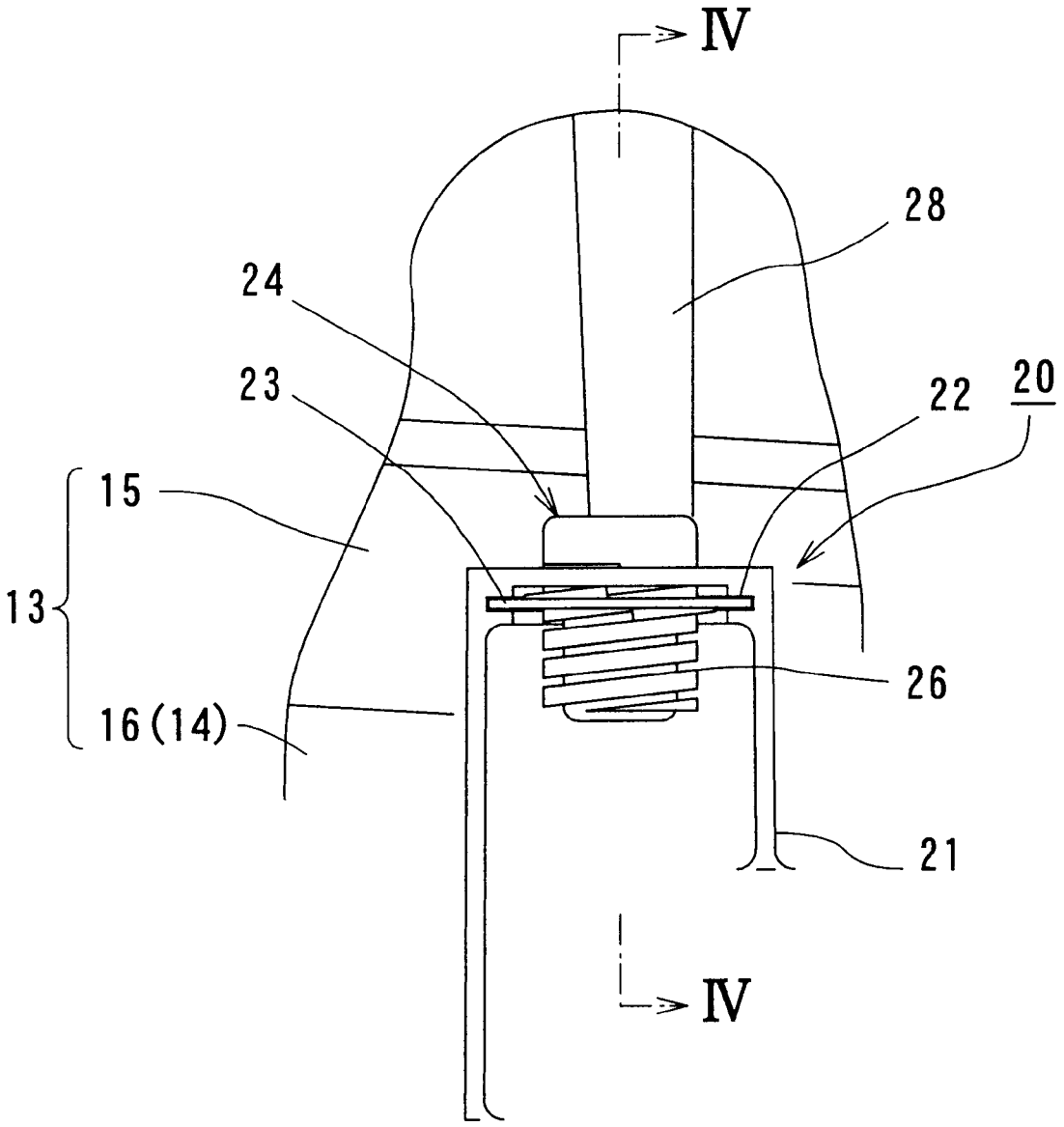
FIG. 3 is a partial view showing a height adjusting structure of the outboard motor.
Figure 4:
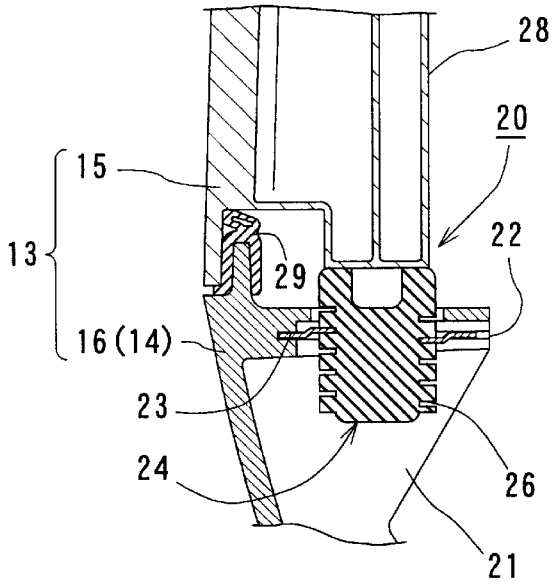
FIG. 4 is a sectional view taken along the line IV—IV of FIG. 3.
Figure 5:
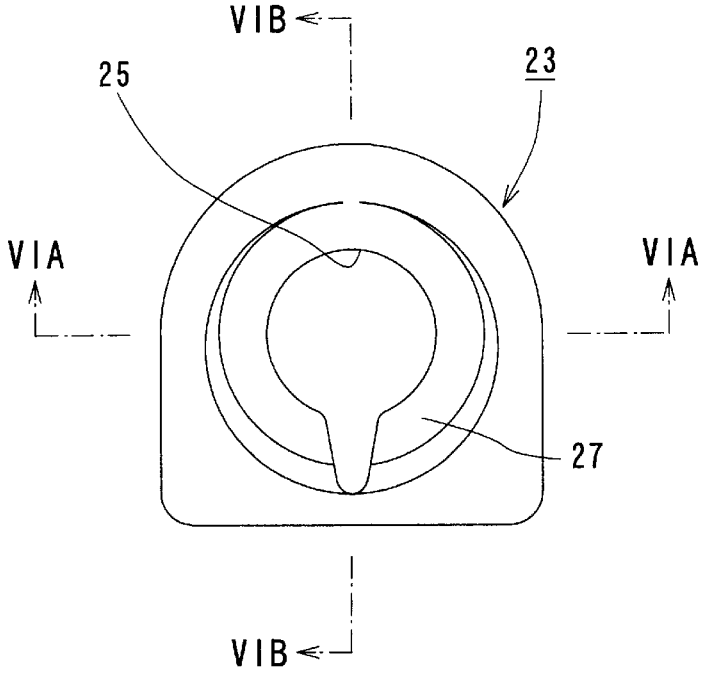
FIG. 5 is a plan view of a cushioning member holder of the outboard motor.
Figure 6A:
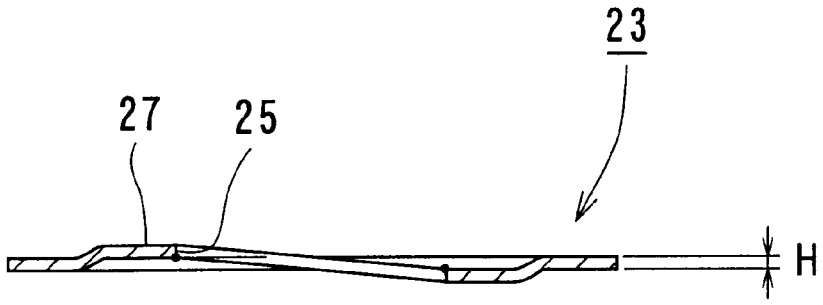
FIGS. 6A and 6B are sectional views taken along the lines VIA—VIA and VIB—VIB of FIG. 5, respectively.
Figure 6B:
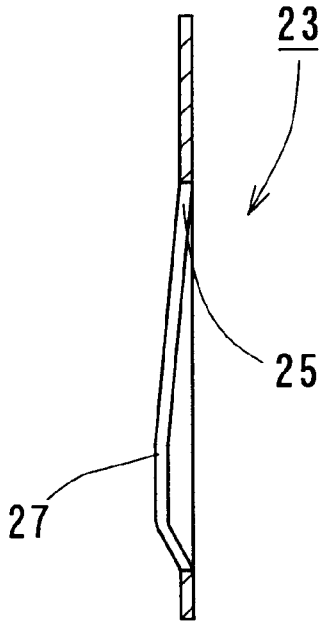

As shown in FIGS. 1 and 2, a bilateral pair of height adjusting devices 20 are arranged at inside portions of the rear end of the lower cover section 14 at substantially the same horizontal level. The height adjusting device 20 has a function as a cushioning member such as shown in FIG. 3. FIG. 4 is a sectional view taken along the line IV—IV of FIG. 3.

With reference to FIGS. 1 to 4, a holder mounting piece 21 is integrally formed to the inside portion of the rear end of each of the side cover members 16. The holder mounting piece 21 is formed with a holder insertion groove 22 in shape of slit extending in the horizontal direction, for example, and a cushion holder 23 is detachably fitted or inserted into the holder insertion groove 22. The cushion holder 23 is formed with a cushion hole 25 to which a cylindrical cushioning member 24 made of an elastic material such as rubber is fittable.

Then, with reference to FIGS. 3 to 6, the cushioning member 24 is formed with a thread 26 having a continuous helical shape, and the cushion hole 25 of the cushion holder 23 is formed with a screw portion 27 having a width H (in FIG. 6A) corresponding to one pitch of the thread 26. The cushioning member 24 is screw engaged with the cushion holder 23 and is moved vertically in its axial direction by rotating the cushioning member 24.

Furthermore, as shown in FIGS. 1, 3 and 4, a rib 28 is integrally formed to the upper cover section 15 disposed directly above the cushioning member 24, and in a state where the upper cover section 15 is closed, the rib 28 abuts against the upper portion of the cushioning member 24. As shown in FIG. 4, a sealing member 29 such as rubber is disposed at a mating portion of the upper cover section 15 and the side cover members 16 of the lower cover section 14 thereby to keep the water-tight state in the engine cover 13.

The embodiment of the present invention of the structure mentioned above will operate as follows.

The sealing member 29 made of rubber material has deteriorated as time elapses and a gap is caused between the mating surfaces of the upper and lower cover sections 15 and 14, thus degrading the water-tight performance. This gap has to be absorbed by adjusting the height of the upper cover section 15.

When the cushioning member 24 is engaged with the cushion holder 23 through the screw engagement of the thread 26 with the screw 27 and then rotated by a hand, for example, the cushioning member 24 is moved vertically thereby to easily adjust the height of the upper cover section 15. Such height adjusting device 20 is provided for each of the side cover members 16 of the lower cover section 14 at substantially the same horizontal level, so that both the devices 20 are operated together or alone as occasion demands with the same amount or different amount, for example.

Furthermore, since the height adjusting devices 20 are disposed inside the lower cover section 14 of the engine cover 13, the outer appearance thereof is not damaged.

Still furthermore, since the thread 26 formed to the cushioning member 24 is engaged with the female screw 27 of the cushion hole 25 of the cushion holder 23 by the amount corresponding to one pitch of the thread 26, the cushioning member 24 is screw engaged with the cushion holder 23 and is smoothly and surely moved vertically in its axial direction by rotating the same, for example, manually.

Still furthermore, since the cushion holder 23 can be easily fitted, in the detachable manner, to the holder insertion groove 22 in shape of slit formed to the holder mounting piece 21 of the side cover member 16, the cushion holder 23 can be easily mounted or dismounted.

Further, it is to be noted that the height adjusting device 20 is applied to the outboard motor 1 in the described embodiment, but it may be applicable to other instruments or like which are provided with cover members or the like to be adjusted in their heights.

What is claimed is:

1. An engine cover unit of an outboard motor in which a surrounding of an engine is covered by an engine cover, said engine cover unit comprising:

a lower cover section covering a surrounding of a lower portion of an engine in a usable state of an outboard motor arranged vertically;

an upper cover section covering a surrounding of an upper portion of the engine, said upper cover section being mounted to be detachable to the lower cover section so as to provide an engine cover when mounted; and a height adjusting means provided to an inside surface of the lower cover section and adapted to adjust a height of the engine cover, said height adjusting means comprising:

a holder mounting member integrally mounted to the inside portion of the lower cover section and formed with a holder insertion groove;

a cushion holder to be inserted into the holder insertion groove;

an elastic member mounted to the cushion holder to be movable in an axial direction thereof; and a rib member provided to the upper cover section, said rib member having an end portion abutting against the elastic member in a state that the upper cover section is closed.

2. An engine cover unit according to claim 1, wherein said cushion holder is formed with an insertion hole into which the elastic member is fitted, said insertion hole being formed with a screw portion and said elastic member is formed with a thread to be engaged with said screw portion thereby to be movable in an axial direction thereof when engaged and rotated, said screw portion having a width corresponding to one pitch of the thread.

3. An engine cover unit according to claim 1, wherein said cushion holder is detachably fitted to the holder insertion hole in shape of slit.

4. An engine cover unit according to claim 1, wherein said elastic member is a cushioning member made of rubber.

5. An engine cover unit according to claim 1, wherein said lower cover section is composed of a bilateral pair of side cover members and said height adjusting means is mounted to each of said side cover members to same horizontal level.

* * * * *

UNITED STATES PATENT AND TRADEMARK OFFICE

CERTIFICATE OF CORRECTION

PATENT NO. : 6,176,751 B1
DATED : January 23, 2001
INVENTOR(S) : Satoru Takahashi It is certified that error appears in the above-identified patent and that said Letters Patent is hereby corrected as shown below:

Title page,
Item [30], Foreign Application Priority Data, should read as follows:
-- [30] Foreign Application Priority Data
August 25, 1998 (JP) ……. 10-239144 --

Signed and Sealed this

Tenth Day of August, 2004

JON W. DUDAS
*Acting Director of the United States Patent and Trademark Office*